United States Patent [19]

Sjöblom

[11] Patent Number: 5,062,286

[45] Date of Patent: Nov. 5, 1991

[54] METHOD AND APPARATUS FOR BENDING CORRUGATED SHEET

[75] Inventor: Bengt I. G. Sjöblom, Norrtälje, Sweden

[73] Assignee: Beco Produktutveckling, Norrtalje, Sweden

[21] Appl. No.: 487,959

[22] PCT Filed: Oct. 25, 1988

[86] PCT No.: PCT/SE88/00566

§ 371 Date: May 10, 1990

§ 102(e) Date: May 10, 1990

[87] PCT Pub. No.: WO89/04222

PCT Pub. Date: May 18, 1989

[30] Foreign Application Priority Data

Nov. 3, 1987 [SE] Sweden ..... 8704304

[51] Int. Cl.[5] ..... B21D 11/20

[52] U.S. Cl. ..... 72/305; 72/379.6

[58] Field of Search ..... 72/305, 312, 379.6, 72/465

[56] References Cited

U.S. PATENT DOCUMENTS

| | | | |
|---|---|---|---|
| 2,638,958 | 5/1953 | Norquist et al. | 72/305 |
| 2,980,046 | 4/1961 | McGregor et al. | 72/465 |
| 4,380,573 | 4/1983 | Naslund | 72/379.6 |

FOREIGN PATENT DOCUMENTS

| | | | |
|---|---|---|---|
| 2608877 | 12/1978 | Australia . | |
| 277472 | 9/1927 | United Kingdom | 72/379.6 |

*Primary Examiner*—Lowell A. Larson

*Attorney, Agent, or Firm*—Ladas & Parry

[57] ABSTRACT

A method and apparatus for folding a corrugated sheet transversely of the corrugations in which the valleys of the corrugated sheet are held clamped against a die in an edging press or like device by tongues of a pressfoot (2) while a fold line or weakening is pressed, in the form of an indentation, into the corrugations crests by a bar (1). The fold line or weakening enables the sheet to be subsequently bent to a desired angle over the edge of a bench or like support surface.

9 Claims, 2 Drawing Sheets

METHOD AND APPARATUS FOR BENDING CORRUGATED SHEET

TECHNICAL FIELD

The present invention relates to a method and apparatus for bending corrugated sheet transversely of the corrugations. The invention is intended preferably for application in the building construction field for roofing purposes and in the construction of industrial buildings and storage locations, tool sheds, etc., in such cases as those where the walls of said building structures are also covered with corrugated sheet. The inventive method can also be used advantageously in other fields, for instance in the provision of corrugated sheet surrounds for loading pallets.

BACKGROUND PRIOR ART

Since corrugated sheet cannot be bent transversely of its corrugations without great difficulty, it is endeavoured to avoid such constructions, by placing joints at angled locations, where the sheets are placed at an angle to one another, and then covering the joints with an angled strip bent from flat sheet. Alternatively, one sheet can be allowed to project over the joint location, when possible. Consequently, there is a need to be able to bend corrugated sheet easily, for instance so that corrugated sheet can be placed over an arris or roof ridge, thereby eliminating the need for separate ridge plates. When constructing sheds or similar, simple storage facilities, an advantage would be gained if one and the same corrugated sheet could be extended from the roof of a building down onto a side wall thereof.

SUMMARY OF THE INVENTION

The object of the invention is to satisfy these requirements, by providing a method and apparatus which will enable the sheet bending process to be divided into two stages, of which only the first stage requires access to an edging press or like tool and the second and last stage can be effected with the aid of simple means. The corrugated sheet is provided in the first stage with one or more fold lines or weakenings along which the sheet can be bent to desired angles in the second sheet bending stage, with the aid of very simple means. The method enables sheet provided with prescribed fold lines or weakenings thereon to be delivered from the factory to the working site, for instance a building structure as before indicated, where the last stage of the sheet bending process can be carried out with the aid of simple means. At the same time, the tool may be given such simple construction as to enable it to be handled by unskilled workmen, without supervision.

BRIEF DETAILED DESCRIPTION OF THE DRAWINGS

Figure 1:
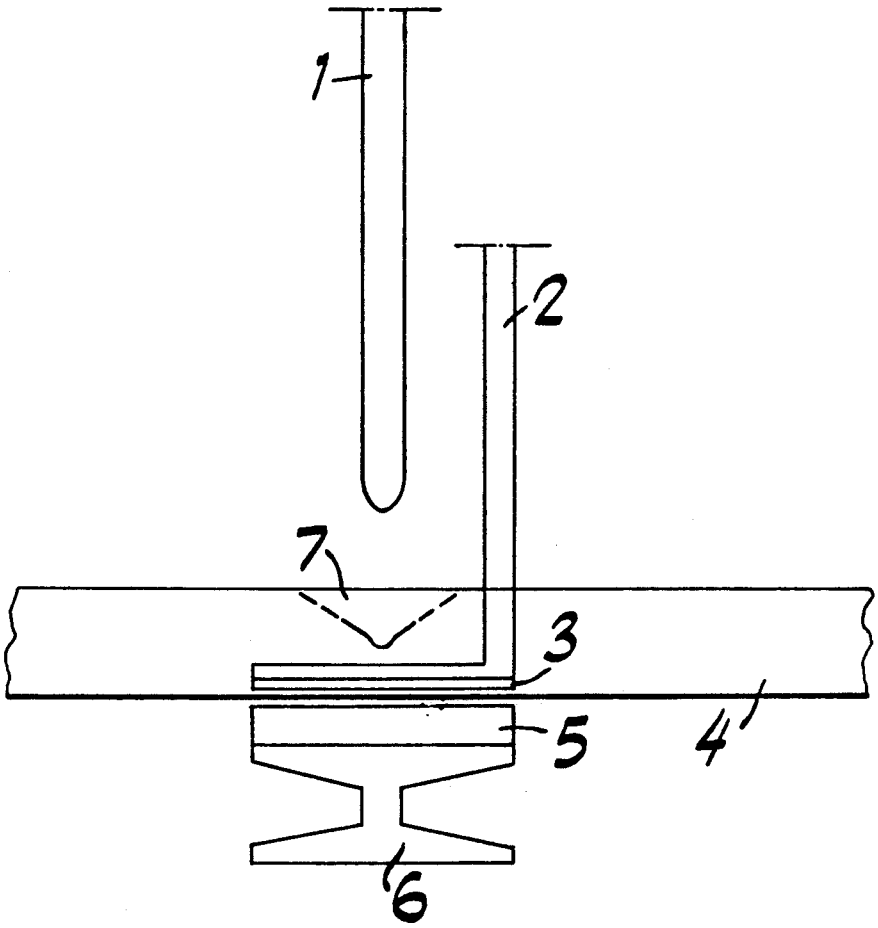
Figure 2:
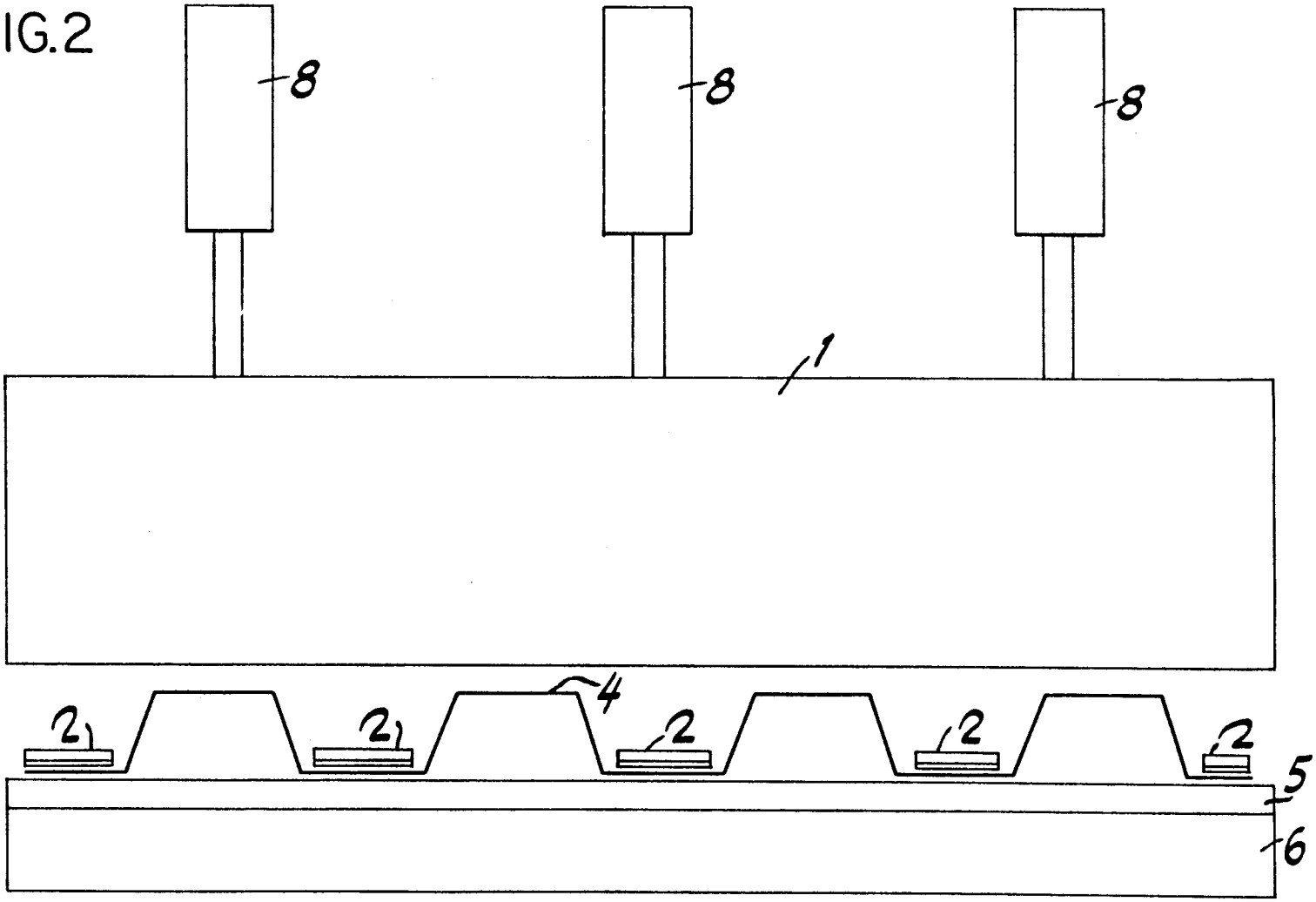

The invention will now be described with reference to the accompanying drawing, in which FIG. 1 illustrates in side view one exemplifying embodiment of the invention and FIG. 2 illustrates the same embodiment in plan view.

DESCRIPTION OF AN EXEMPLIFYING EMBODIMENT

In accordance with the method, which is described herebelow with reference to the accompanying drawings, corrugated sheet 4 is placed in an edging or folding press on a flat die 6, where it is held in place by a tongued pressfoot 2 which is constructed so as to enable it to be brought into pressing engagement with the bottoms of respective sheet corrugations. The tongues of the pressfoot extend across both sides of the sheet location at which a fold line or weakening is to be formed, said fold line or weakening being produced with the aid of a pressbar 1 which has a rounded edge and which is moved towards the die under great force, by means of hydraulic pistons 8 or by suitable equivalent means. As seen in FIGS. 1 and 2 the bar is a flat member which has a lower rectilinear edge extending across all the corrugations. The fold line or weakening takes the form of an a v-shaped indent 7 in the crests of the corrugations in the sheet 4. The depth of the indent 7 can be varied and therewith adapted to the angle to which the sheet is to be bent, by adjusting the length of stroke of the pressbar 1. Since the requisite indent depth for right angle bends will take up only a part of the height of a corrugation, there remains sufficient space in the corrugation valleys to accommodate the pressfoot 2 during the entire pressing operation. The undersurface of the pressfoot and the upper surface of the die are respectively covered with a protective covering 3,5 of rubber of some corresponding material, in order to protect said surfaces against scratching, tearing and other physical damage.

The sheets, thus provided with fold lines, can be transported away and handled as untreated sheet and subsequently bent to a desired angle in the aforesaid second sheet bending stage, e.g. over the edge of a workbench or some like support with the aid of a suitable but simple tool.

In the case of an alternative embodiment, not shown, the pressfoot 2 may have the form of a U-section bar, whose web and limbs have formed therein recesses which correspond to the wave shape of the corrugated sheet, thus supporting the corrugations laterally and preventing undesirable deformation. With this embodiment, pressure can be applied to both limbs of the pressfoot or holder.

What is claimed is:

1. A method for bending corrugulated sheet transversely of its corrugations in two stages; said method comprising in the first stage, placing the corrugated sheet on a flat support, holding the corrugated sheet in position on the support by a tongued pressfoot having tongues brought into pressure engagement with the bottom of valleys of the corrugated sheet, moving a bar towards the flat support to form indentations in the crests of the corrugations and produce a fold line or weakening in the corrugated sheet transversely of the longitudinal axes of said corrugations; and in the second of said stages, bending the sheet over a support edge along the fold line or weakening to an angle determined by said indentation.

2. A method as claimed in claim 1 comprising forming said indentations in the crests of the corrugations over a portion of the depth of said corrugations.

3. A method as claimed in claim 2, said bar extending transversely across the corrugations for forming said indentations in said crests concurrently during movement of the bar towards said flat support.

4. A method as claimed in claim 3 comprising forming said indentations of V-shape in said crests of the corrugations.

5. Apparatus for forming fold lines in a corrugated sheet transversely of the corrugations, said apparatus comprising:

a flat support for a corrugated sheet, a movable pressbar disposed above said support and extending in a plane perpendicular to said support and transversely of corrugations in said sheet, a pressfoot including tongues extending into valleys between adjacent corrugations of said sheet for pressing the sheet at the bottom of the valleys against said support surface, and means including a hydraulic piston for moving the pressbar towards and away from the support surface to form, during the movement towards the support surface, indentations in the crests of the corrugations to define a fold line or weakening in the corrugated sheet.

6. Apparatus as claimed in claim 5 wherein said pressbar has a lower position in which the indentations in the crests of the corrugations extend over a portion of the depth of the corrugations.

7. Apparatus as claimed in claim 5 wherein said press bar comprises a flat member having a rectilinear lower pressing edge.

8. Apparatus as claimed in claim 7 wherein said pressing edge is rounded.

9. Apparatus as claimed in claim 5 wherein said tongues of said pressfoot are disposed below said pressbar when the pressbar is in a lower position.

* * * * *